US010415219B2

(12) United States Patent
Bamford

(10) Patent No.: US 10,415,219 B2
(45) Date of Patent: Sep. 17, 2019

(54) FLUID RESTRICTION NOZZLE FOR HAND WASHING

(71) Applicant: Nigel Bamford, Brighton (GB)

(72) Inventor: Nigel Bamford, Brighton (GB)

( * ) Notice: Subject to any disclaimer, the term of this patent is extended or adjusted under 35 U.S.C. 154(b) by 203 days.

(21) Appl. No.: 15/315,381

(22) PCT Filed: May 29, 2015

(86) PCT No.: PCT/GB2015/051577
§ 371 (c)(1),
(2) Date: Nov. 30, 2016

(87) PCT Pub. No.: WO2015/185897
PCT Pub. Date: Dec. 10, 2015

(65) Prior Publication Data

US 2017/0183849 A1 Jun. 29, 2017

(30) Foreign Application Priority Data

Jun. 2, 2014 (GB) ..... 1409765.3

(51) Int. Cl.

| | |
|---|---|
| ***E03C 1/086*** | (2006.01) |
| ***B05B 1/04*** | (2006.01) |
| ***E03C 1/08*** | (2006.01) |
| ***E03C 1/02*** | (2006.01) |

(52) U.S. Cl.
CPC ..... *E03C 1/086* (2013.01); *B05B 1/04* (2013.01); *B05B 1/046* (2013.01); *E03C 1/02* (2013.01); *E03C 1/08* (2013.01); *E03C 2001/026* (2013.01)

(58) Field of Classification Search
CPC ..... E03C 1/086; B05B 1/04; B05B 1/044; B05B 1/046
See application file for complete search history.

(56) References Cited

U.S. PATENT DOCUMENTS

| | | | | |
|---|---|---|---|---|
| 259,667 | A * | 6/1882 | Churchman | F23D 14/586 239/552 |
| 3,129,894 | A | 4/1964 | Schermerhorn | |
| 3,214,102 | A * | 10/1965 | Meyer | B05B 15/528 239/107 |
| 3,640,472 | A * | 2/1972 | Hruby, Jr. | B01F 3/0473 239/17 |

(Continued)

FOREIGN PATENT DOCUMENTS

| | | |
|---|---|---|
| CN | 201720144 | 1/2011 |
| EP | 2705904 | 3/2014 |

(Continued)

*Primary Examiner* — Reinaldo Sanchez-Medina
(74) *Attorney, Agent, or Firm* — Lightbulb IP, LLC

(57) ABSTRACT

A flow restriction nozzle (100) comprising an interior surface, an exterior surface, an inlet (103) at a first portion of the nozzle (100) for connection to a fluid source, and an outlet (106) at a second portion of the nozzle (100) for providing a fluid flow, connecting the interior surface to the exterior surface, wherein a portion of the interior surface tapers radially inwardly towards the second portion and the outlet (106) comprises an elongated aperture (106) formed in the interior surface extending at least partially along the tapered surface such that a portion of the fluid flow through the outlet (106) is directed radially outwardly.

20 Claims, 8 Drawing Sheets

(56) References Cited

U.S. PATENT DOCUMENTS

| | | | | |
|---|---|---|---|---|
| 3,773,257 | A * | 11/1973 | Hruby, Jr. | B05B 17/08 239/17 |
| 4,718,607 | A | 1/1988 | Levine | |
| 5,108,606 | A | 4/1992 | Maglio | |
| 5,868,325 | A | 2/1999 | Tassinari | |
| 7,090,155 | B1 * | 8/2006 | Rabitsch | B05B 1/046 239/518 |
| 2008/0283635 | A1 * | 11/2008 | Fecht | B05B 1/042 239/590 |
| 2009/0114745 | A1 * | 5/2009 | Elliott | E03C 1/086 239/600 |
| 2009/0314856 | A1 | 12/2009 | Romanov | |
| 2011/0284661 | A1 | 11/2011 | Chang | |
| 2014/0103147 | A1 * | 4/2014 | Dodson | B05B 1/02 239/597 |

FOREIGN PATENT DOCUMENTS

| | | |
|---|---|---|
| NL | 7808562 | 2/1980 |
| WO | WO96/27647 | 9/1996 |
| WO | WO97/20999 | 6/1997 |

* cited by examiner

FLUID RESTRICTION NOZZLE FOR HAND WASHING

BACKGROUND OF THE INVENTION

The present invention relates to a fluid flow restriction nozzle and, in particular, a nozzle for use with a tap for hand washing.

SUMMARY OF THE INVENTION

It is desirable to reduce water consumption in both the home and commercial premises. One way of doing so is to reduce the water flow rate from taps, such as those used in kitchens and bathrooms. It is known to use nozzles on taps in order to reduce the flow of fluid therethrough. Commonly used nozzles include aerating nozzles. However, such nozzles may not provide a sufficient reduction in fluid flow. Therefore, there remains a need for reducing the flow of fluid from a tap further, while still providing a flow that is capable of cleaning a user's hands.

The present invention seeks to solve the problems associated with the prior art nozzles.

One aspect of the present invention provides a flow restriction nozzle comprising an interior surface, an exterior surface, an inlet, at a first portion of the nozzle, for connection to a fluid source and an outlet, at a second portion of the nozzle for providing a fluid flow, connecting the interior surface to the exterior surface. A portion of the interior surface tapers radially inwardly towards the second end. The outlet comprises an elongated aperture formed in the interior surface extending at least partially along the tapered surface such that a portion of the fluid flow through the outlet is directed radially outwardly.

The outlet extends between the interior and exterior surfaces. The nozzle is at least partially hollow, with the hollow portion forming a flow channel between the inlet and the outlet. The outlet is in fluid communication with the inlet. The elongated aperture defines an entrance into the outlet on the interior surface. The exterior surface will also have some kind of opening defining an exit from the outlet.

It should be understood that the tapered surface may have any shape. The taper may or may not be continuous.

The term "radially outwardly" should be understood to refer to a direction extending radially away from the general direction of fluid flow at the second portion of the nozzle prior to the elongated aperture, which may correspond to the central axis of the nozzle at the second portion. It should be understood that it is not required that a portion of the fluid flows radially outwards at 90° to the nozzle from the outlet. Instead, what is required is that a portion of the fluid is directed from the outlet in a direction that extends at an angle to the nozzle, such that as the fluid flows away from the outlet, it moves radially outwards. In other words, as the portion of fluid flows away from the nozzle the width of the flow becomes (much) greater than that of the outlet through which it has flowed, i.e. the flow spreads out in the radial direction.

The tapered surface tapers radially inwardly to define a reduced cross-sectional area of the flow channel adjacent the second portion of the nozzle. The elongated aperture extends along the tapered surface along a direction of taper. For example, the elongated aperture may extend in an upstream direction from the second portion (i.e. towards the first portion) following the tapered surface. The elongated aperture allows the flow channel to access the outlet at a different length from the second portion, i.e. at points where the cross-sectional flow area is different. The part of the elongated aperture extending upstream serves to direct fluid flow radially outwards.

The first and second portions of the nozzle may be first and second ends, which may be opposed. The nozzle may comprise a body extending between the first and second ends. Alternatively, the first and/or second portions may be located between the first and second ends of a nozzle body.

The fluid source may be a tap, such as a tap located above a basin for hand washing.

The term 'elongated' should be understood to mean that the length of the aperture is substantially longer than its width, where the width is measured perpendicularly to the length across the interior surface. For example, the length may be at least ten, twenty, thirty, forty or more times longer than the width. The aperture can therefore be considered to be a slit.

The expression 'formed in the interior surface' should be understood to mean that an interior surface defined by the nozzle includes and defines the aperture. In other words, the interior surface extends around (i.e. surrounds) the aperture. It should be understood that the interior surface may be formed from two or more separate parts that together define a continuous surface that includes the aperture. However, preferably, the interior surface is defined by a single part.

Providing an outlet in the form an elongated aperture extending through a tapered surface creates a sheet of fluid (e.g. water) that spreads out radially (in the direction of the length of the aperture) as it moves away from the nozzle to produce a veil or dome shaped flow. In other words, the width of the sheet is much larger than the width (i.e. diameter) of the nozzle. The fluid is directed along a plane that extends both away from the outlet and perpendicular to the central axis of the nozzle (i.e. in a radial direction). The sheet of fluid may be a substantially planar sheet or, alternatively, may have some curvature in the radial direction.

The term 'planar sheet' should be understood to mean a three dimensional flow of fluid that is substantially flat and thus has a much smaller thickness than width and length (distance from nozzle). For example, a perfectly planar sheet of fluid would resemble a sheet of glass.

A sheet having some curvature in the radial direction can be considered to resemble a piece of paper having a length extending away from the nozzle and a curved cross-section taken along the width direction, for example a smooth S-shape.

The sheet of fluid uses much less water than a tap alone or a tap having an aerating nozzle. For example, while an aerating nozzle may aim to reduce mains water flow to a flow rate of less than 6 liters per minute, the nozzle of the present invention may reduce the flow rate to less than 3 liters per minute, such as 2 liters per minute.

The sheet of fluid provides a surprising amount of wetting power (and thus cleaning power) for the flow rate of water being used.

Increasing the flow of water flowing into the nozzle, by opening the tap further causes the sheet of fluid to become wider (i.e. to spread out more in the radial direction), and to remain as a sheet for a longer distance from the nozzle. If the flow rate is too low, the sheet will be too narrow and may break down before it reaches the user's hands or the sink, and thus provide less wetting power.

Preferably, a flow channel extending between the inlet and outlet is linear or substantially linear, so that fluid travels between the inlet and outlet in a substantially straight line.

The aperture may extend along a substantially straight path over the tapered surface. In other words, while the aperture defines a non-straight (three-dimensional) path due to the tapering of the interior surface, it defines a straight path along the interior surface as it travels over the tapered surface. This provides a substantially planar sheet of fluid, i.e. little or no curvature in the radial direction.

The straight path may be perpendicular to the central axis of the nozzle at the second portion or to the general direction of fluid flow prior to the aperture.

The interior surface may taper continuously to form a curved surface, i.e. with no interruptions or steps. Alternatively, the tapering could be non-continuous, i.e. formed of steps.

The interior surface may taper symmetrically around an axis of the nozzle (for example the central axis at the second portion). Alternatively, the tapering may be asymmetrical about at least one axis.

The tapered surface may extend along a substantially uniform angle of curvature in at least one direction.

The tapered surface may have the same angle of curvature (and thus radius) in all directions, i.e. a hemispherical portion.

The tapered surface may comprise a section of a spherical surface. In other words, the tapered surface defines a surface that if extended would form a sphere. Preferably, the tapered surface comprises a substantially hemispherical surface. Alternatively the tapered surface could be a smaller section of a spherical surface, i.e. a section that is less than a hemisphere.

Alternatively, the tapered surface may comprise a section of a cylindrical surface. In this embodiment, the portion of the cylindrical surface extends from a rectangular boundary and the elongated aperture extends between two points on the boundary such that the aperture is a curved outlet. Preferably, the aperture extends over the circumferential surface in a direction that is perpendicular to the central longitudinal axis of the portion of the cylindrical surface.

The elongated aperture may extend over the apex of the tapered surface, particularly where it is the only aperture. The term 'apex' should be understood to mean the most distal point of the tapered surface, as measured from a plane from which the tapered surface extends. The apex may be defined by a point or a line on the tapered surface. In use, the apex will define the point (or line) of the tapered surface that will be closest to the user's hands, e.g. where the sheet of water is directed downwardly, the apex will be the lowest part of the tapered surface (and the nozzle).

The elongated aperture may extend beyond the tapered surface into an upstream non-tapered surface.

Alternatively, the elongated aperture may not extend to the upstream edge (or boundary) of the tapered surface.

The tapered surface may extend from a circular boundary and the elongated aperture may extend between two points on the boundary. The two points may be diametrically opposed, i.e. separated by 180 degrees, measured from the centre of the circle formed by the circular boundary. When the tapered surface is a section of spherical surface, such as a hemispherical surface, an elongated aperture extending from diametrically opposed points will bisect the surface.

Alternatively, the tapered surface may extend from a circular boundary and the elongated aperture may not extend to the circular boundary, i.e. the elongated aperture may be fully surrounded by, but not reach, the circular boundary.

As previously discussed, the elongated aperture has a length, along which it extends across the interior surface (along the tapered surface), and a width, across the interior surface, which is transverse to the length.

The elongated aperture may have a maximum width, at the interior surface of the nozzle, of between 0.5 mm and 4 mm or less than 4 mm or between 1 mm and 3 mm or less than 3 mm, such as about 1 mm or about 2 mm, or less than 1 mm.

The length of the aperture may be at least 10 mm, between 10 mm and 40 mm, between 10 mm and 30 mm, between 15 mm and 25 mm or about 20 mm.

The depth of the aperture, i.e. the thickness of the nozzle measured from the interior to the exterior surface adjacent the aperture may be less than 5 mm, less than 2 mm or about 1 mm. The depth of the aperture may or may not be substantially constant along its length.

The outlet comprises an exterior aperture formed in the exterior surface. The outlet therefore extends between the interior aperture and the exterior aperture. The exterior aperture may be elongated, and optionally may be complementary in shape to the interior elongated aperture, i.e. it may have a similar shape (but not necessarily the same dimensions).

The maximum width of the exterior aperture at the exterior surface may be less than 5 mm, less than 3 mm, less than 2 mm, less than 1 mm, less than 0.5 mm, or even less than 0.4 mm, such as between 0.25 mm and 0.35 mm, or about 0.3 mm.

The width of at least a part (or the whole) of the length of the elongated aperture at the interior surface may be different to the width of the exterior aperture at the exterior surface, i.e. the width of the outlet may vary through its depth.

Preferably, the width of at least part of the elongated aperture at the interior surface is greater than the width of at least that part of the exterior aperture at the exterior surface, i.e. the width of the respective apertures may be greater at the interior surface than the exterior surface at any particular point along the length of the aperture. Providing a width reduction as the outlet extends from the interior to the exterior surface provides a funnel-like effect, which creates a more stable sheet of water. In other words, the sheet of fluid retains its shape for a longer distance from the nozzle. Preferably, the width is greater at the interior surface than the exterior surface, along the whole length of the aperture. As discussed above, the aperture may have a width between about 0.25 mm and 0.35 mm at the exterior of the device.

The change in width thought the depth may be gradual and continuous. Alternatively, the change in width may be non-continuous e.g. stepped.

The outlet may be defined by first and second walls extending from the interior surface to the exterior surface, wherein the separation of the first and second walls decreases through the depth of the aperture (from the interior surface to the exterior surface). The first and second walls extend along the length of the aperture. Both the first and second walls may be angled towards each other. The first and second walls may be symmetrical about an imaginary line extending through the depth of the aperture. Alternatively, one wall may have a different angle to the other wall, or not be angled at all.

The width of the interior and/or exterior apertures may be uniform along its length. Thus, the aperture may form a rectangular shape bent over the tapered surface.

Alternatively, the width of the interior and/or exterior apertures may vary along its length.

For example, the width may be greater at its longitudinal ends than at a midpoint positioned between the ends, such that the aperture forms, for example, a dog-bone or hour-glass type shape, bent over the tapered surface. The variation in length may be continuous (e.g. smooth) or non-continuous (e.g. stepped). Increasing the width of the aperture at its longitudinal ends has the effect of widening the sheet of water. For example, the exterior aperture may widen gradually at the centre from about 0.30 mm to about 0.31 mm at the lateral edges.

Alternatively, the width of the aperture may be less at its longitudinal ends than at a midpoint positioned between the ends. This has the effect of lengthening the sheet of water (along a distance extending away from the tap), and may be especially useful in conjunction with a long aperture, such as one extending beyond a hemispherical portion, as will be described below.

The midpoint of the aperture is located at a position equidistant from both ends of the aperture. The aperture may be symmetrical about the midpoint in a lateral and/or longitudinal direction, wherein the lateral direction extends in the direction of the width of the aperture and the longitudinal direction extends in the direction of the length of the aperture.

The exterior surface may be complementarily shaped to (i.e. substantially the same shape as) the interior surface. For example, the exterior surface may have a portion corresponding generally to the tapered portion on the interior surface. The exterior surface may therefore be curved, e.g. hemispherical. Alternatively, the exterior surface may have a very different shape to the interior surface, such as a flat or cubed shape. All that is necessary is that the exterior surface is shaped to not obstruct flow through the outlet from the interior aperture.

The elongated interior aperture may be a first interior aperture and the outlet may further comprise a second elongated interior aperture formed in the interior surface and extending at least partially over the tapered surface. Preferably, the second elongated interior aperture does not intersect the first elongated interior aperture. The second elongated interior aperture may be parallel to the first elongated interior aperture.

Providing two interior apertures creates two sheets of water which will provide more cleaning power, while still saving a considerable amount of water (compared to not using a flow restriction nozzle).

The second elongated interior aperture may have the same width, length and/or depth as the first elongated interior aperture. Alternatively, the second elongated interior aperture may have a different width, length and/or depth to the first elongated interior aperture. The elongated interior apertures may have the same or different characteristics of any of length, width and depth.

The second elongated interior aperture may have any of the features described above in relation to the first interior aperture, for example the width of the second aperture may vary through its depth, including any of the features of claims 1 to 22.

One elongated interior aperture may be wider than the other. In this embodiment, the wider elongated interior aperture will provide a larger flow rate and more stable flow (i.e. the sheet of water will retain its shaper for longer). In use, the aperture providing the fluid sheet causing the least splashing may be positioned in front of (i.e. closer to the user) the aperture providing the fluid sheet causing the most splashing, to shield the user from excess splashing. In another embodiment, a further sheet of water may be provided behind the existing two sheets by having a third elongated interior aperture.

Alternatively, the first and second elongated interior apertures may have the same width. This may provide increased cleaning power for similar water consumption, as, for example, two 0.1 mm apertures may provide better cleaning power than a single 0.2 mm aperture.

The first and second elongated interior apertures may be spaced apart either side of an apex (as previously defined) of the tapered surface at the second portion of the nozzle. The first and second elongated interior apertures may be spaced apart from the apex by the same distance or by different distances.

The first and second elongated interior apertures may be in fluid communication with each other within the nozzle.

Alternatively, the nozzle may further comprise means for defining first and second flow channels within the nozzle, the first flow channel extending between the inlet and the first elongated interior aperture and the second flow channel extending between the inlet and the second elongated interior aperture, wherein the first and second flow channels are not in fluid communication with each other within the nozzle. The means prevents fluid communication between the flow channels within the nozzle i.e. between the inlet and the outlet. It will be understood that the first and second fluid flow channels may be in fluid communication outside of the nozzle, in particular at or prior to the inlet, as it is intended that the fluid flowing through the first and second fluid flow channels originates from the same source and is split, after the inlet, to flow into the two flow channels. Separating the first and second flow channels allows different flow rates to be provided to different apertures.

The means may comprise a dividing wall. The dividing wall may be integrally formed with at least the interior surface of the nozzle.

It will be understood that the nozzle can comprise any number of interior and exterior apertures forming the outlet. For example, the nozzle may comprise one aperture, two apertures, three apertures, four apertures, or more than four apertures. The apertures may have the same or different characteristics to each other. There may or may not be means for defining separate flow channels between some or all of the apertures and the inlet.

The surface may further comprise a cylindrical portion extending between the inlet and the tapered surface. The cylindrical portion may define the inlet. The inlet may have a diameter of between 10 mm and 30 mm. When the tapered surface comprises a section of a spherical surface, the tapered surface and the cylinder may have the same longitudinal axis, which runs through the centre of the cylinder and the centre point of both the circular boundary of the tapered surface and a centre point on the tapered surface which is equidistant from all points on the circular boundary (i.e. the apex of the tapered surface). The circular boundary of the tapered surface need not have the same radius as the cylinder. In such embodiments, an optional flange connects the circular boundary to the end of the cylinder. For example, the circular boundary may have a smaller radius than the cylinder, such that the flange extends radially inwardly from the cylinder to the tapered surface. The tapered surface and the cylinder (and the optional flange) may be formed integrally.

The elongated interior aperture(s) may extend into the cylindrical portion. This results in a wider sheet of water than if the aperture only extended along the tapered surface. The aperture may, for example, extend a few millimeters up each side of the cylinder. Preferably, each longitudinal end of the elongated aperture(s) extends about 0.1 mm to about 3 mm into the cylindrical portion.

The nozzle may be formed by injection moulding a plastic material, such as polypropylene.

The nozzle may further comprise means for restricting (i.e. reducing) fluid flow between the inlet and the elongated aperture or apertures to restrict flow therebetween. The flow restricting means may be positioned adjacent the inlet. The means may be a washer having at least one aperture therein. The aperture(s) could be located at any position on the washer. There may be one aperture or a plurality of apertures.

In embodiments having a plurality of interior apertures and separate flow paths thereto, there may be one or a plurality of washer apertures in fluid communication with each flow path. It is also envisaged that there may be no aperture into one of the flow paths. Such a washer can be used, for example, to modify a device having two apertures to have just one functioning aperture.

A washer can be used in combination with any of the embodiments, including those having a single aperture and those having a double aperture but no dividing wall. In these embodiments, the introduction of the washer, with at least one aperture in it, forms a single chamber behind the aperture(s) in order to limit the pressure behind the aperture(s) in all cases. In this way, a fully open tap cannot produce an undesirably powerful spray. In the above described embodiment wherein a flow separating washer is used in combination with the double aperture, dividing wall embodiment, the washer can create different pressures behind the different apertures. The flow separating washer should be adapted to fit the embodiment of nozzle it is to be used therewith. For example, if there is one or more dividing walls, there should be one or more grooves in the washer to mate therewith. If there are no dividing walls, the washer need not comprise a groove.

The nozzle (according to any of the above embodiments) may further comprise means for engaging a fluid source, such as a tap. The engaging means may comprise a circumferential lip extending at least partially around (and defining) the inlet. The outer edge of the lip extends laterally outwards from the nozzle such that the lip is the widest part of the nozzle.

The lip may, in use, engage with a corresponding lip or flange on a tap. The portion of a tap engaged by the circumferential lip may be a threaded retaining portion (e.g. a nut). The threaded retaining portion may define a fluid outlet having a diameter of approximately 10 mm to 20 mm.

The inner surface of the lip may be wider than the adjacent portion (e.g. the cylindrical portion) of the interior surface of the nozzle such that the previously described flange is formed therebetween. In embodiments wherein a washer is used, the washer may be sized such that it has a larger diameter than the adjacent portion (e.g. the cylindrical portion) of the nozzle and a smaller diameter than the inner surface of the lip, so that it will sit on the lip.

The present invention also provides a tap assembly comprising a tap and a flow restriction nozzle as described above wherein the nozzle is engaged with the tap via the engaging means. The tap may comprise means for engaging the flow restriction nozzle. Said means may comprise a threaded nut that screws onto a (main) portion of the tap. In use, the nozzle may be fitted between the (main) portion of the tap and the threaded nut.

The present invention also comprises a method of modifying a tap comprising fitting a fluid restriction nozzle as described above to a tap such that fluid flow from the tap passes through the elongated aperture or apertures. The method may comprise screwing a threaded retaining nut onto a main portion of a tap, with the nozzle held between the nut and the main portion of the tap.

DETAILED DESCRIPTION OF THE INVENTION

In the below described embodiments, the interior and exterior elongated apertures of the flow restriction nozzle are formed on a hemispherical surface. However, it should be understood that the apertures can be formed on any tapered surface, such as the edge of a cylinder, provided that the aperture extends over the tapered surface, i.e. along the direction of curvature/tapering.

Figure 1:
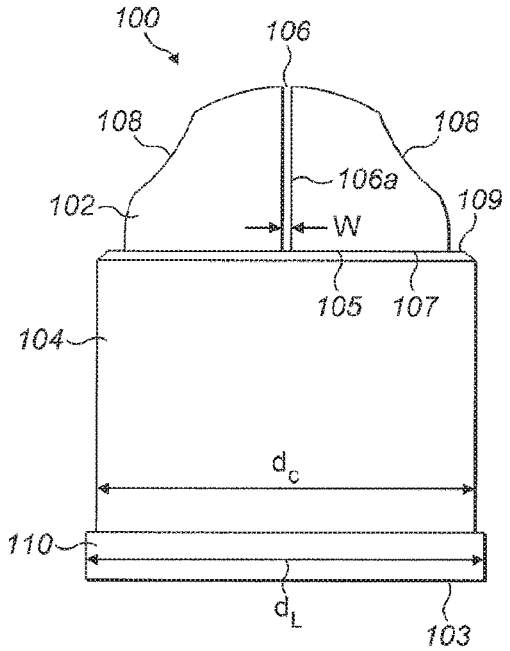
FIG. 1 shows a side view of a flow restriction nozzle in accordance with an embodiment of the present invention.
Figure 2:
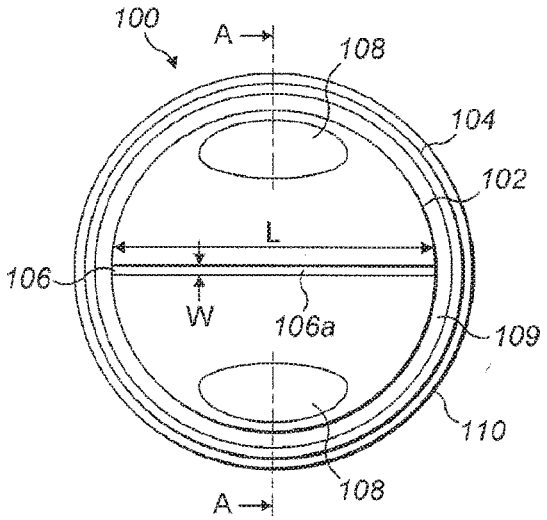
FIG. 2 shows a top view of the nozzle of FIG. 1.
Figure 3:
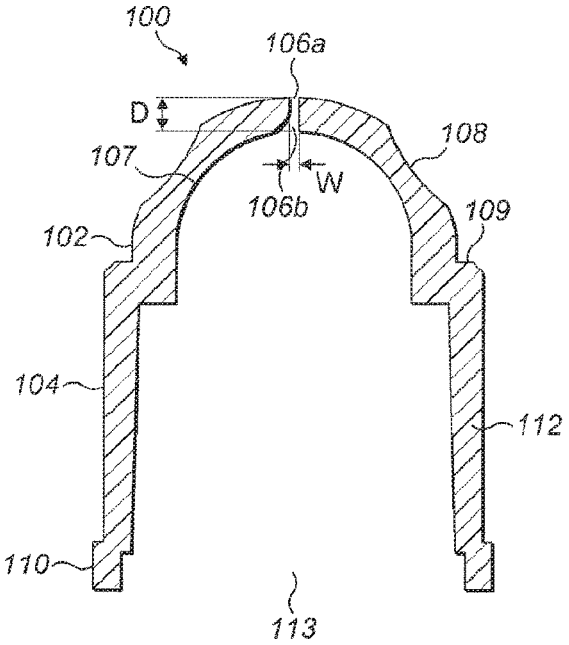
FIG. 3 shows a cross-sectional view of the nozzle of FIGS. 1 and 2 along line A-A.

FIGS. 1 to 3 show a flow restriction nozzle 100 having a single aperture 106. The nozzle 100 comprises a cylindrical portion 104 and a hemispherical portion 102. The nozzle 100 is hollow and is formed from injection moulded plastic. The walls 1 12 of the nozzle 100 are approximately 1 mm thick (in non-thinned regions). The cylindrical portion 104 and hemispherical portion 102 are arranged such that the circular end 107 of the hemispherical portion 102 abuts the distal circular end 105 of the cylindrical portion 04. Due to the differing radii, an optional flange 09 extends therebetween. The cylindrical portion further comprises a lip 110 proximal open end 103 of the cylindrical portion 104, the lip 110 having an outer diameter $d_L$ larger than the outer diameter $d_c$ of the cylindrical portion 104.

Outlet 106 extends through the hemispherical portion 102 from an elongated interior aperture 106*b* to an elongated exterior aperture 106*a*. Each aperture 106*a*, 106*b* has a width W, a length L and a depth D, wherein the depth D corresponds to the thickness of the nozzle 100 adjacent the aperture 106*a*, 106*b*. The exterior aperture 106*a* has a width of about 0.25 to 0.3 mm. The width W may vary along the length L and/or the depth D of the exterior and interior apertures 106*a*, 106*b*.

The hemispherical portion 102 comprises two depressions 108, one on each side of the outlet 106. These aid positioning of the nozzle 100 during installation. Preferably, the nozzle 00 will be oriented so as the maximise ease of use, maximise the size of the sheet of fluid (e.g. water) able to be accommodated by a basin beneath the tap and minimise splash and spray. Usually, this involves orienting the apertures 106*a*, 106*b* and, therefore, the sheet of fluid, such that it is parallel to the front edge of a basin beneath the tap. As can be seen in FIG. 3, the interior surface 107 of the hemispherical portion 102 is not interrupted by these depressions 108—it still has a smooth hemispherical shape. However, it should be understood that the depressions 108 could also protrude into the interior of the nozzle 100.

FIG. 3 shows a cross-sectional view of the nozzle 100 of FIGS. 1 and 2, taken along line A-A on FIG. 2. FIG. 3 shows the inlet 113 at the proximal open end 103 of the nozzle. As also shown in FIG. 3, the width W of the outlet 106 widens through its depth D such that it is wider on the interior of the nozzle 100. Thus, the outlet 106 has a funneled profile. In use, this produces a sheet of fluid that is more stable (i.e. wider and longer) for any given speed of flow. Such a wide, long sheet provides an improved flow for the purpose of, for example, cleaning hands. The aperture may be between about 1 and 3 mm at the interior surface of the nozzle, such as approximately 2 mm. The aperture may be between about 0.3 and 0.31 mm at the exterior surface of the nozzle.

Figure 4:
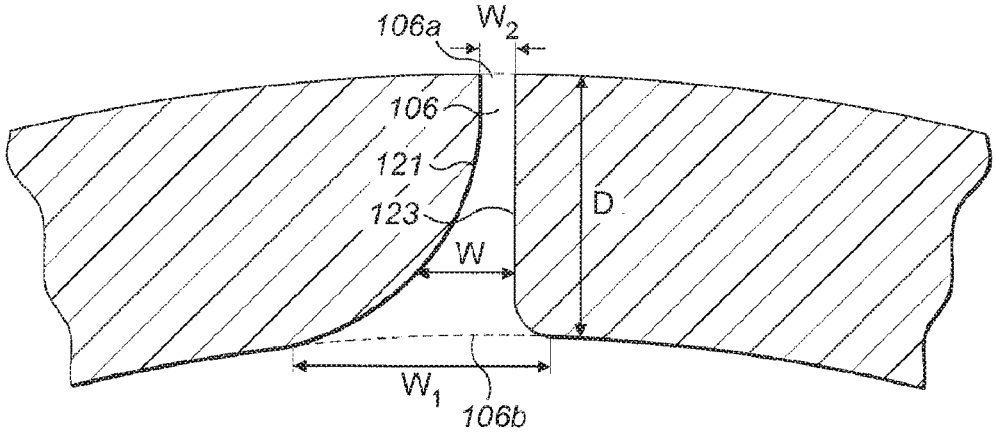
FIG. 4 shows an enlarged view of a possible configuration of an aperture for use with the nozzle of FIGS. 1 to 3.
Figure 5:
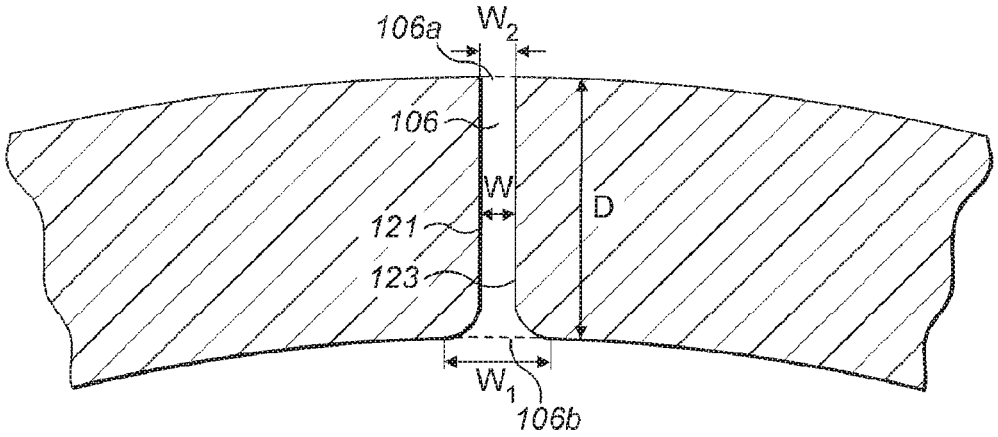
FIG. 5 shows an enlarged view of an alternative configuration of an aperture for use with the nozzle of FIGS. 1 to 3.

The funnel profile may be formed by tapering the walls 121, 123 extending between the interior and exterior surfaces of the nozzle 104 through the depth D of the outlet 106. FIGS. 4 and 5 show enlarged views of possible apertures 106. The outlets 106 have a varying width W along the depth D. The width W at the exterior of the nozzle $W_2$ is less than the width at the interior of the nozzle $W_1$. FIG. 4 shows an enlarged view of the nozzle of FIG. 3, in which the two sides 121, 123 of the outlet 106 have different tapers, i.e. the tapering is asymmetrical. In an alternative embodiment, as shown in FIG. 5, both sides 121, 123 of the outlet 106 have equal tapers, i.e. the tapering is symmetrical. The embodiment of FIG. 5 may provide a more predictable flow without detrimentally affecting the flow or the stability of the sheet. However, the embodiment of FIG. 4 may be easier to manufacture.

Figure 6:
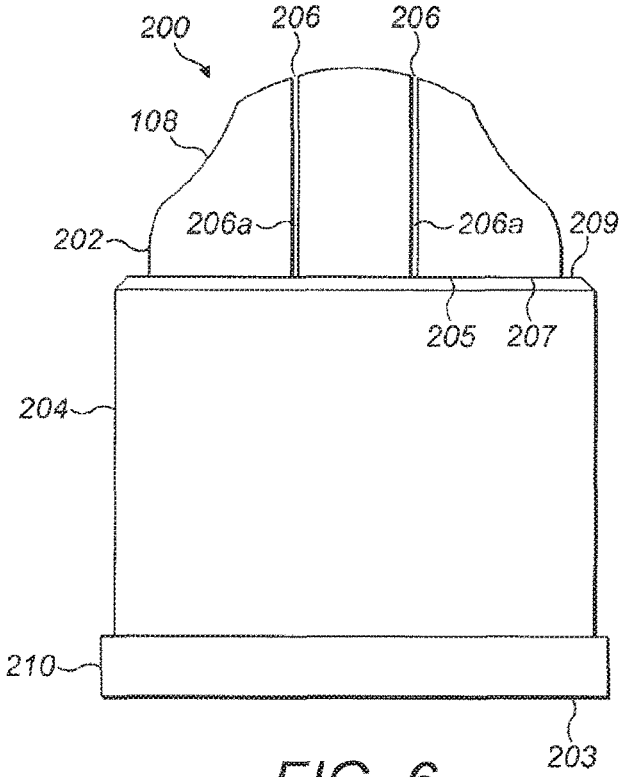
FIG. 6 shows a side-view of a flow restriction nozzle in accordance with an embodiment of the present invention.
Figure 7:
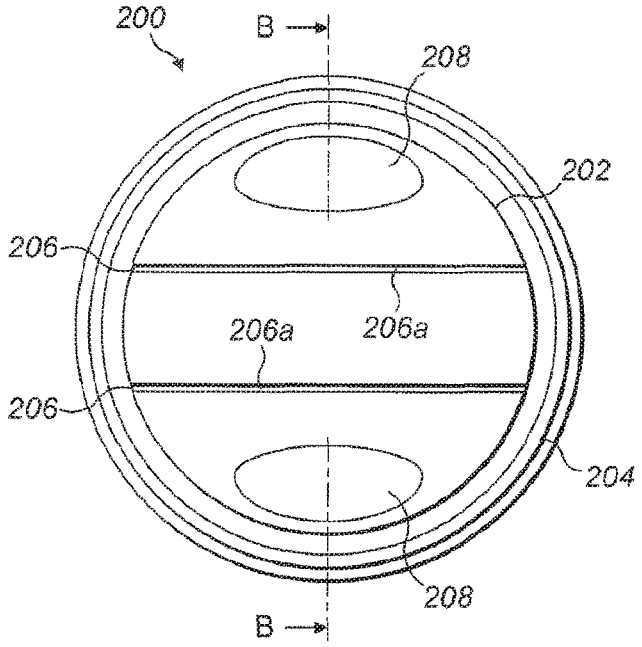
FIG. 7 shows a top view of the nozzle of FIG. 6.

FIGS. 6 and 7 show an alternative embodiment of a flow restriction nozzle 200. The nozzle 200 is similar in structure to that of the single aperture embodiment of FIGS. 1 to 3, being formed of a cylindrical portion 204 and a hemispherical portion 202. However, in this embodiment, there are two outlets 206 formed in the hemispherical portion 202. The two outlets 206 create two sheets of fluid and thus provide a greater cleaning power compared to one of the outlets 206 alone, without having to increase the speed of flow, which could create undesired spray. The outlets 206 are parallel to each other, although this is not essential. The exterior and interior apertures 206*a*, 206*b* may or may not have the same width W or the same funnel profile. The apertures 106*a*, 106*b*, taken separately, may have any of the length L, width W, depth D or funneling characteristics described previously.

Figure 8:
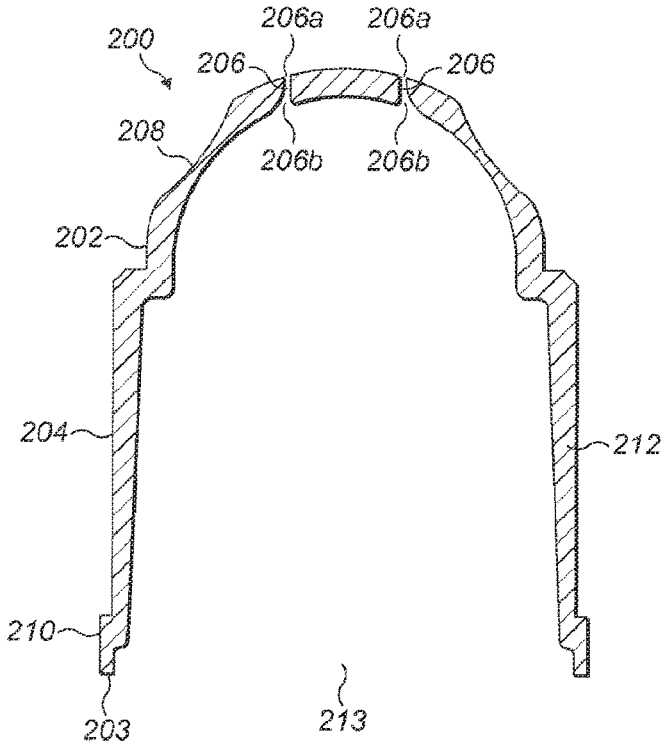
FIG. 8 shows a cross-sectional view of the nozzle of FIGS. 6 and 7 along line B-B.

FIG. 8 shows a cross-sectional view of the flow restriction nozzle 200 of FIGS. 6 and 7 taken along line B-B in FIG. 7. The pressure of water behind both outlets 206 will be the same. However, the flow rate exiting the outlets 206 can be different, as the apertures 206*a*, 206*b* can each have a different depth profile, width or length, as in previously described embodiments.

Figure 9:
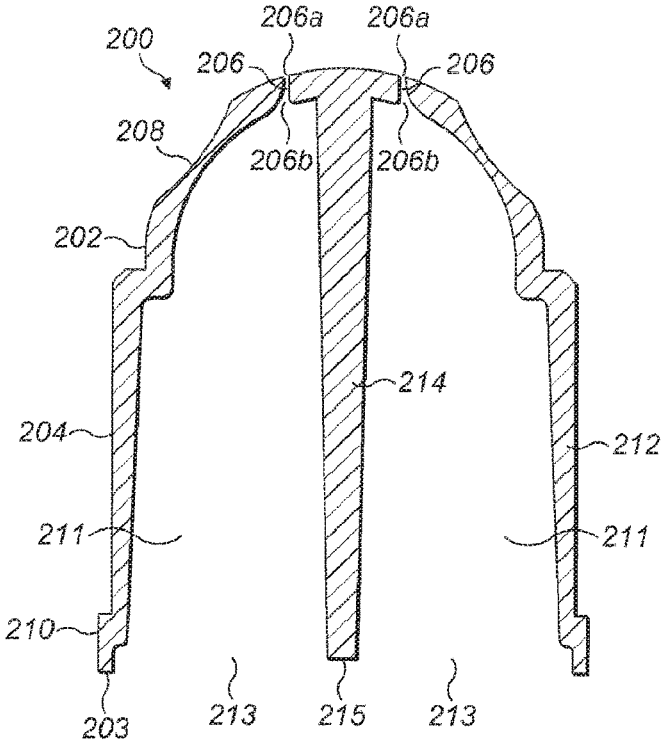
FIG. 9 shows an alternative cross-sectional view of a nozzle of FIGS. 6 and 7 in accordance with an embodiment of the present invention.

FIG. 9 shows a cross-sectional view of an alternative embodiment of the flow restriction nozzle 200 of FIGS. 6 to 8 taken along line B-B in FIG. 7. As can be seen in FIG. 8, the nozzle 200 comprises an optional dividing wall 214. The dividing wall 214 bisects the nozzle 200 in the longitudinal direction, wherein the longitudinal direction extends in the axis direction of the cylinder, and forms two chambers 211, which are not in fluidic communication with each other within the nozzle 200. One outlet 206 (and apertures 206, 206*b*) is formed on each side of dividing wall 214. Thus, the outlets 206 are in fluidic communication (within the nozzle) with different chambers 211 and not with each other.

Figure 10A:
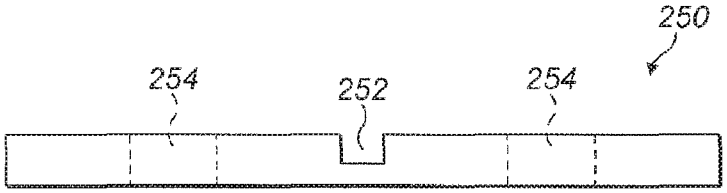
FIG. 10A shows a side view of a flow separation washer for use with the nozzle of FIGS. 6 to 8.
Figure 10B:
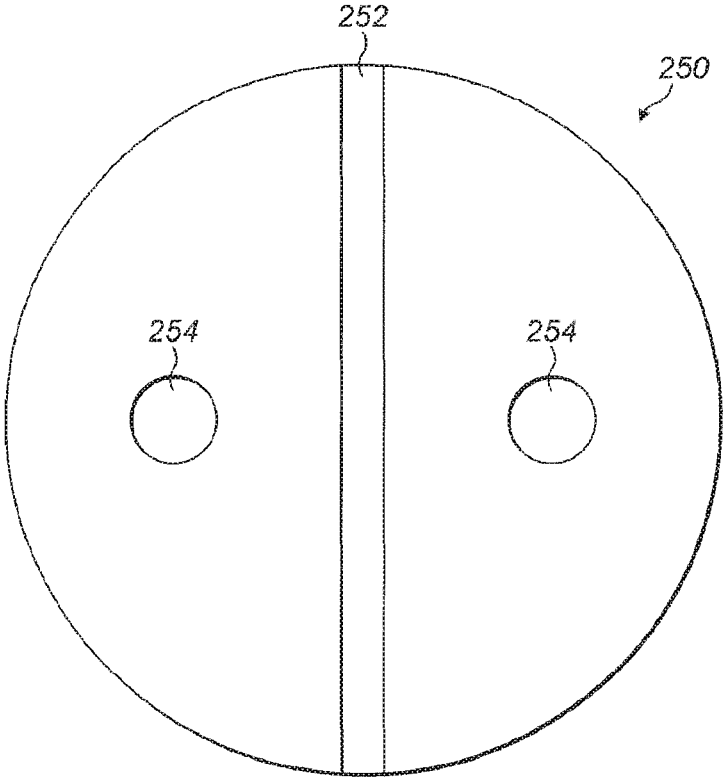
FIG. 10B shows a top view of a flow separation washer for use with the nozzle of FIGS. 6 to 8.

FIGS. 10A and 10B show a flow separating washer 250 for use with the nozzle 200 of FIG. 9. The washer 250, in use, will fit sealingly into the proximal end 203 of the cylindrical portion 204, abutting the interior portion of the lip 210.

FIG. 10A shows the washer 250 in side view. The washer 250 is flat, apart from a groove 252 running down the length of the centre of the washer. In use, the groove 252 engages the end 215 of the dividing wall 214.

FIG. 10B shows a plan view of the washer 250. The washer 250 includes two apertures 254, one on each side of the groove 252. In use, therefore, one aperture 254 opens into each chamber 212 of the nozzle 200 either side of the dividing wall 214. The apertures 254 therefore restrict the flow of fluid into the chambers formed by the nozzle 200, the wall 214 and the washer 250. The apertures 254 are different sizes and are located substantially centrally in each side of the washer 250, although other locations may be suitable.

Figure 11A:
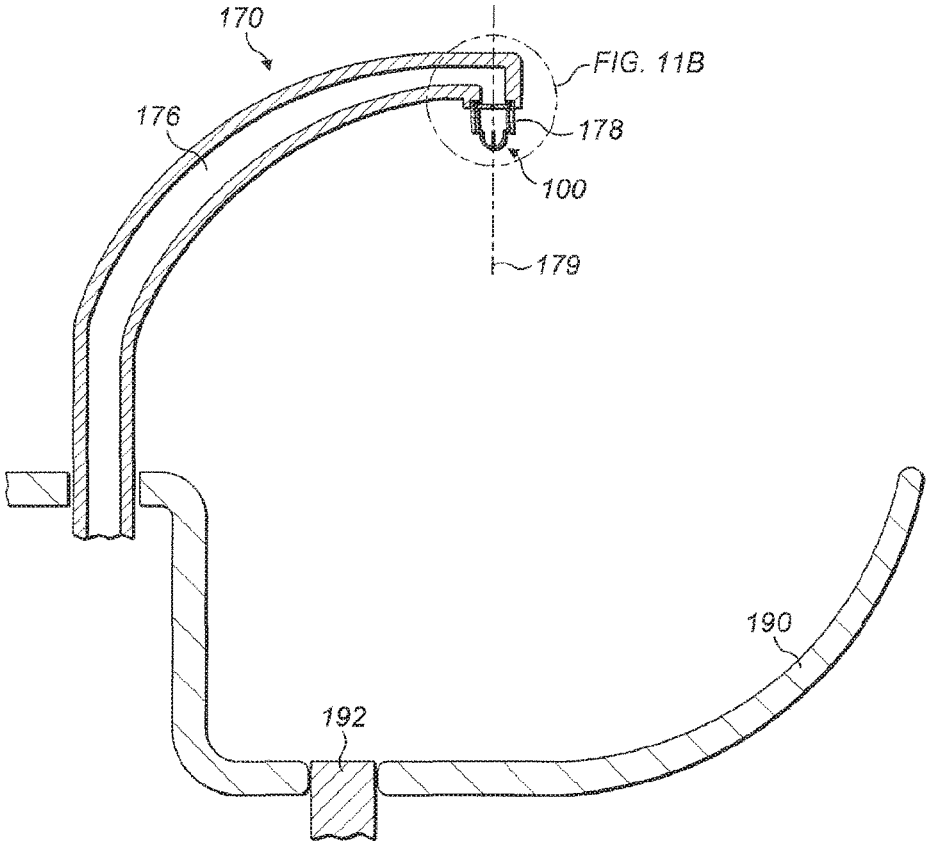
FIG. 11A shows a tap assembly including a nozzle in accordance with the present invention.
Figure 11B:
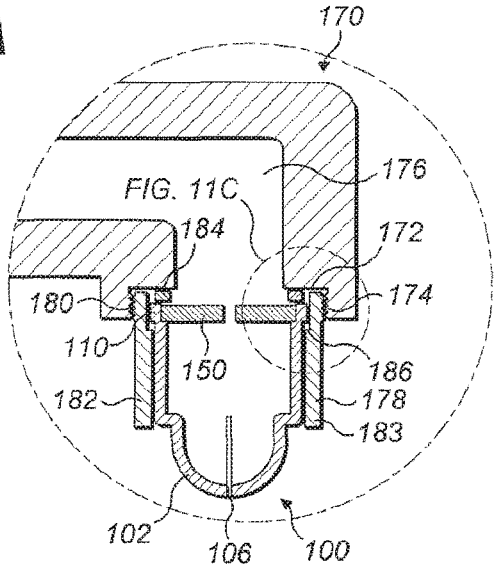
FIG. 11B shows an enlarged view of a portion of the tap assembly.

FIG. 11A shows a tap assembly 171 fitted with a nozzle 100 of any of FIGS. 1 to 3. FIG. 11 B shows an enlarged view of a portion of the tap assembly 171 of FIG. 11 A. FIG. 110 shows an enlarged view of a portion of the tap assembly 171 of FIG. 11B.

Figure 11C:
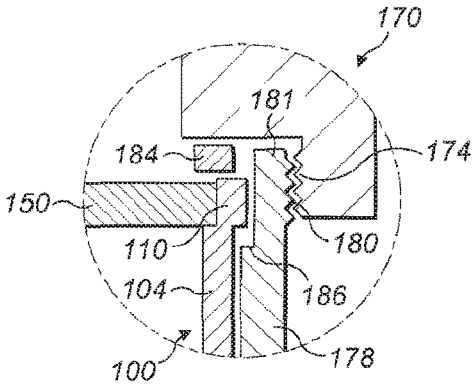
FIG. 11C shows an enlarged view of a portion of the tap assembly.

With reference to FIGS. 11A-C, tap assembly 171 includes a tap 170 having a flow channel 176 and a sink basin 190 having a plug hole 192. The flow reducing nozzle 100 is attached using a threaded retaining nut 178. The tap has a cylindrical outlet 172 including a threaded portion 174 and a threaded retaining nut 178 screwed into the outlet 172, extending the flow channel 176. The nut 178 has a threaded portion 180 at the first end 181 and a non-threaded portion 182 at the second end 183. The non-threaded portion 182 has a smaller internal diameter than the threaded portion 180, thus forming an interior lip 186. When the nut 178 is screwed into the outlet 172, the first end 181 of the nut 178 is proximate the outlet 172. A ring washer 184 may be located between the nut 178 and the outlet 172 to form a seal therebetween.

To install the nozzle 100, a user unscrews the threaded retaining nut 178 from the tap assembly 171. The nozzle 100 is passed through the nut 178 so that the lip 110 of the nozzle 100 sits on the interior lip 186 of the nut 178. The lip 110 of the nozzle 100 has an exterior diameter that is greater than that of the rest of the nozzle 100 and the non-threaded portion 182 of the nut 178 but less than that of the threaded portion 180. The user may optionally then slot a flow separating washer 150 into the first end 181 of the nozzle 100 so that it abuts the interior of the lip 110 of the nozzle 100. The user may optionally then slot a standard ring washer 184 into the first end 181 of the threaded retaining nut 178. The user then screws the threaded retaining nut 178 back into the outlet 172. When the nut 178 is partially screwed in place, i.e. still loose, the user may rotate the nozzle 100 about the longitudinal axis 179 so as to orient the aperture 106 as desired, optionally using the depressions 108 (not shown in FIGS. 11A to 11 C) for additional grip. The threaded retaining nut 178 is then tightly screwed in place, such that the flow channel 176 is sealed until it reaches the outlet 106, and such that the nozzle 102 cannot rotate from the desired orientation.

The tap 170 is used as normal, except that it will not need to be turned on to the usual extent, as less water is needed to provide a sheet.

While FIGS. 11A to 110 show a nozzle 100 having a single aperture 106, it should be understood that a nozzle 200 having two apertures 106 (or more) can be attached to the tap assembly 171 in the same manner.

It should also be understood that while a tap assembly 171 having a nut 178 with an external thread 180 is shown, some taps instead have a nut 178 that screws onto the outside of the tap 170, i.e. the nut has an internal thread and the tap 170 has an external thread. The nozzle 100, 200 of the present invention can equally be used with such an assembly 170.

FIGS. 12A-D show an alternative embodiment of a flow restricting nozzle 300 having a single slit 306. The second portion of the nozzle 300 is shown. It will be understood that the second portion may be attached to a first portion (such as cylindrical portion 104), which is not shown.

Figure 12A:
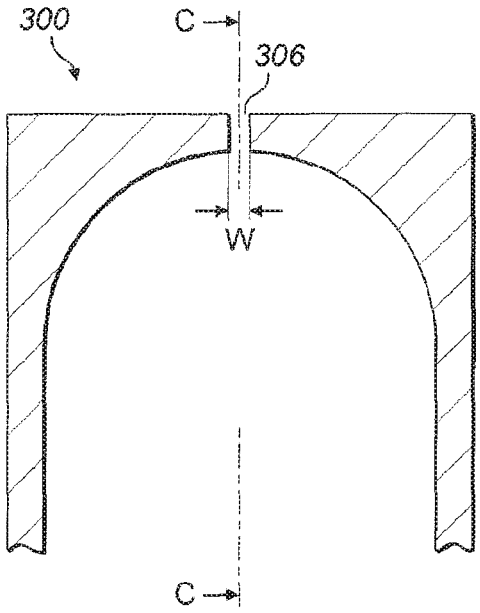
FIG. 12A shows a cross-sectional view of a nozzle in accordance with another embodiment of the present invention.

FIG. 12A shows a cross-sectional view of the nozzle showing the second end of the nozzle 300, comprising an aperture 306 having a width W. The interior surface of the second end of the nozzle 300 is hemispherical. The aperture 306 is formed in the hemispherical surface. The exterior surface of the nozzle 300 has a cubic shape.

Figure 12B:
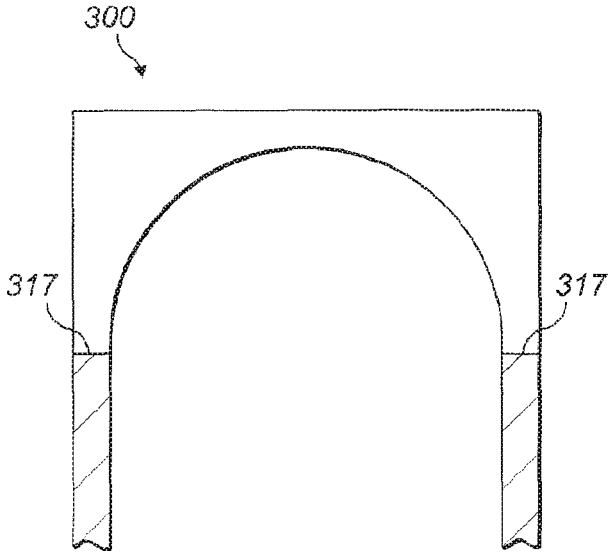
FIG. 12B shows a cross-sectional view of the nozzle of FIG. 12A taken along line C-C.

FIG. 12B shows a cross-sectional view of the nozzle of FIG. 12A taken along line C-C. As can be seen more clearly in FIGS. 12C and 12D, the aperture 306 extends between two aperture ends 317.

Figure 12C:
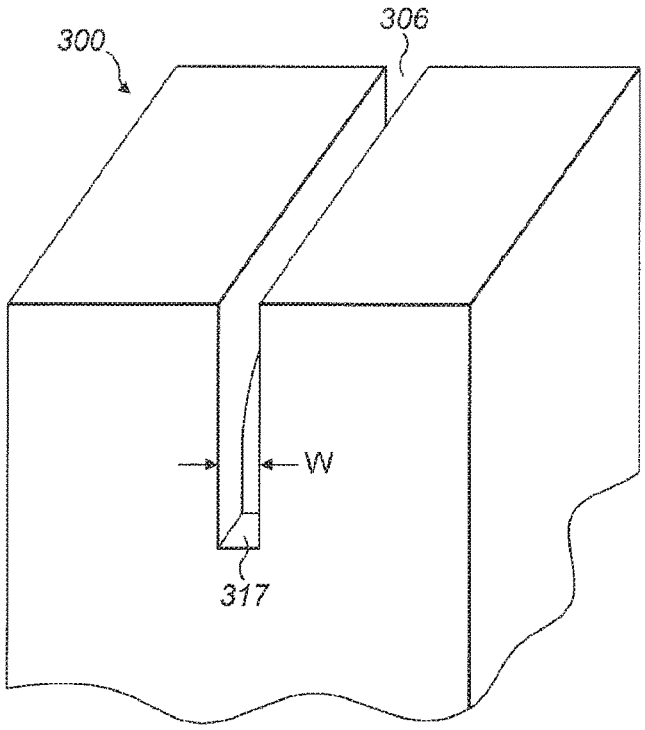
FIG. 12C shows a front view of the nozzle of FIGS. 12A and B.

FIG. 12C shows a front view of the nozzle of FIGS. 12A and 12B. The exterior of the aperture 306 has a squared profile whilst, as can be seen more clearly in FIG. 12D, the interior of the aperture 306 has a hemispherical profile.

Figure 12D:
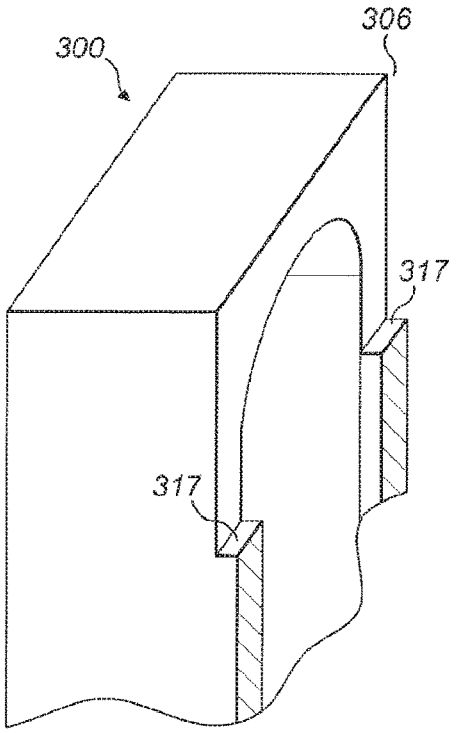
FIG. 12D shows a sectional view of the nozzle of FIGS. 12A, B and C.

FIG. 12D shows a sectional front view of the nozzle of FIGS. 12A-C. showing the aperture 306 and ends 317.

The invention claimed is:

1. A flow restriction nozzle comprising:

an interior surface;

an exterior surface;

an inlet, at a first portion of the flow restriction nozzle, for connection to a fluid source; and an outlet, at a second portion of the flow restriction nozzle for providing a fluid flow, connecting the interior surface of the flow restriction nozzle to the exterior surface of the flow restriction nozzle, wherein a portion of the interior surface is a tapered surface that tapers radially inwardly towards the outlet at the second portion, wherein the outlet comprises and extends between an elongated interior aperture formed in the interior surface and an elongated exterior aperture formed in the exterior surface, wherein the elongated interior aperture extends at least partially along the tapered surface in a length direction (L) along the tapered surface, whereby the elongated interior aperture is bent over the tapered surface, such that a portion of the fluid flow through the outlet is directed radially outwardly to provide fluid flow in a sheet of fluid that spreads out radially in the length direction (L), wherein the outlet has a width direction (W) between first and second walls that extend between the interior surface and the exterior surface in a depth direction (D) of the outlet, said width direction (W) transverse to said length direction (L), and wherein at least part of the outlet has a width (W) that varies in the depth direction (D) such that the width ($W_2$) of the outlet at the exterior surface of the flow restriction nozzle is less than the width ($W_1$) of the outlet at the interior surface of the flow restriction nozzle, whereby the separation of the first and second walls decreases through the depth of the outlet from the tapered surface to the exterior surface.

2. The flow restriction nozzle of claim 1, wherein the elongated interior aperture extends along a straight path along the tapered surface.

3. The flow restriction nozzle of claim 2, wherein the straight path is perpendicular to a central axis of the flow restriction nozzle at the second portion.

4. The flow restriction nozzle of claim 1, wherein the width ($W_1$) of the outlet at the interior of the flow restriction nozzle varies along the length of the elongated interior aperture.

5. The flow restriction nozzle of claim 4, wherein the elongated interior aperture comprises longitudinal ends and the width ($W_1$) of the outlet at the interior of the flow restriction nozzle is less at the longitudinal ends of the elongated interior aperture than at a midpoint positioned between the longitudinal ends of the elongated interior aperture.

6. The flow restriction nozzle of claim 4, wherein the elongated interior aperture comprises longitudinal ends and the width ($W_1$) of the outlet at the interior of the flow restriction nozzle is greater at the longitudinal ends of the elongated interior aperture than at a midpoint positioned between the longitudinal ends of the elongated interior aperture.

7. The flow restriction nozzle of claim 1, further comprising a second outlet that comprises and extends between a second elongated interior aperture formed in the interior surface and a second elongated exterior aperture formed in the exterior surface.

8. The flow restriction nozzle of claim 7, wherein the second elongated interior aperture does not intersect the first elongated interior aperture.

9. The flow restriction nozzle of claim 7, wherein the second elongated interior aperture is parallel to the first elongated interior aperture.

10. The flow restriction nozzle of claim 7, wherein the first and second elongated interior apertures are spaced apart either side of an apex of the tapered surface by one of: the same distance; different distances.

11. The flow restriction nozzle of claim 7, wherein the first and second elongated interior apertures are in fluid communication with each other within the flow restriction nozzle.

12. The flow restriction nozzle of claim 7, wherein the flow restriction nozzle further comprises a dividing wall for defining first and second flow chambers within the flow restriction nozzle, a first flow channel extending between the inlet and the first elongated interior aperture through one of the first and second chambers and a second flow channel extending between the inlet and the second elongated interior aperture through the other of the first and second chambers, wherein the first and second flow channels are not in fluid communication with each other within the flow restriction nozzle.

13. The flow restriction nozzle of claim 1, wherein the interior surface tapers continuously to form a curved surface.

14. The flow restriction nozzle of claim 1, wherein the interior surface tapers symmetrically around an axis of the flow restriction nozzle at the second portion.

15. The flow restriction nozzle of claim 1, wherein the tapered surface comprises a section of a spherical surface.

16. The flow restriction nozzle of claim 1, wherein the tapered surface comprises a hemispherical surface.

17. The flow restriction nozzle of claim 1, wherein the elongated interior aperture extends beyond the tapered surface into an upstream non-tapered surface.

18. The flow restriction nozzle of claim 1, wherein the exterior surface is complementarily shaped to the interior surface.

19. A tap assembly, comprising:

a tap; and a flow restriction nozzle comprising:

an interior surface;

an exterior surface;

an inlet, at a first portion of the flow restriction nozzle, for connection to a fluid source; and an outlet, at a second portion of the flow restriction nozzle for providing a fluid flow, connecting the interior surface of the flow restriction nozzle to the exterior surface of the flow restriction nozzle, wherein a portion of the interior surface is a tapered surface that tapers radially inwardly towards the outlet at the second portion, wherein the outlet comprises and extends between an elongated interior aperture formed in the interior surface and an elongated exterior aperture formed in the exterior surface, wherein the elongated interior aperture extends at least partially along the tapered surface in a length direction (L) along the tapered surface, whereby the elongated interior aperture is bent over the tapered surface, such that a portion of the fluid flow through the outlet is directed radially outwardly to provide fluid flow in a sheet of fluid that spreads out radially in the length direction (L), wherein the outlet has a width direction (W) between first and second walls that extend between the interior surface and the exterior surface in a depth direction (D) of the outlet, said width direction (W) transverse to said length direction (L), and wherein at least part of the outlet has a width (W) that varies in the depth direction (D) such that the width ($W_2$) of the outlet at the exterior surface of the flow restriction nozzle is less than the width ($W_1$) of the outlet at the interior surface of the flow restriction nozzle, whereby the separation of the first and second walls decreases through the depth of the outlet from the tapered surface to the exterior surface.

20. A method of modifying a tap, the method comprising the step of fitting a fluid restriction nozzle to a tap such that fluid flow from the tap passes through an outlet of the fluid restriction nozzle;

wherein the fluid restriction nozzle comprises:

an interior surface;

an exterior surface;

an inlet, at a first portion of the flow restriction nozzle, for connection to a fluid source; and an outlet, at a second portion of the flow restriction nozzle, connecting the interior surface of the flow restriction nozzle to the exterior surface of the flow restriction nozzle, wherein a portion of the interior surface is a tapered surface that tapers radially inwardly towards the outlet at the second portion, wherein the outlet comprises and extends between an elongated interior aperture formed in the interior surface and an elongated exterior aperture formed in the exterior surface, wherein the elongated interior aperture extends at least partially along the tapered surface in a length direction (L) along the tapered surface, whereby the elongated interior aperture is bent over the tapered surface, such that a portion of the fluid flow through the outlet is directed radially outwardly to provide fluid flow in a sheet of fluid that spreads out radially in the length direction (L), wherein the outlet has a width direction (W) between first and second walls that extend between the interior surface and the exterior surface in a depth direction (D) of the outlet, said width direction (W) transverse to said length direction (L), and wherein at least part of the outlet has a width (W) that varies in the depth direction (D) such that the width ($W_2$) of the outlet at the exterior surface of the flow restriction nozzle is less than the width ($W_1$) of the outlet at the interior surface of the flow restriction nozzle, whereby the separation of the first and second walls decreases through the depth of the outlet from the tapered surface to the exterior surface.

* * * * *